US010137321B2

(12) United States Patent
Martin

(10) Patent No.: US 10,137,321 B2
(45) Date of Patent: Nov. 27, 2018

(54) FILTERING FACE-PIECE RESPIRATOR HAVING AN INTEGRALLY-JOINED EXHALATION VALVE

(71) Applicant: 3M INNOVATIVE PROPERTIES COMPANY, St. Paul, MN (US)

(72) Inventor: Philip G. Martin, Forest Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/925,442

(22) Filed: Oct. 28, 2015

(65) Prior Publication Data

US 2016/0045772 A1 Feb. 18, 2016

(51) Int. Cl.

| | |
|---|---|
| ***A62B 23/02*** | (2006.01) |
| ***A62B 9/02*** | (2006.01) |
| ***A62B 18/02*** | (2006.01) |
| ***A62B 18/10*** | (2006.01) |
| ***A62B 7/10*** | (2006.01) |
| ***A41D 13/11*** | (2006.01) |

(52) U.S. Cl.

CPC ..... *A62B 23/025* (2013.01); *A41D 13/1138* (2013.01); *A62B 7/10* (2013.01); *A62B 9/02* (2013.01); *A62B 18/02* (2013.01); *A62B 18/10* (2013.01)

(58) Field of Classification Search

CPC ..... A61B 18/02; A61B 18/025; A61B 18/06; A61B 18/10; A62B 9/02–9/027; A62B 23/02; A62B 23/025

See application file for complete search history.

(56) References Cited

U.S. PATENT DOCUMENTS

| | | | | |
|---|---|---|---|---|
| 1,502,450 A | | 7/1924 | Wood | |
| 1,701,277 A | | 2/1929 | Shindel | |
| 2,284,949 A | | 6/1942 | Cover | |
| 2,290,885 A | * | 7/1942 | Lehmberg | A41D 13/1146 128/206.15 |
| 2,382,364 A | * | 8/1945 | Yant | A62B 18/02 128/201.19 |
| 2,893,387 A | * | 7/1959 | Gongoll | A62B 18/00 128/206.15 |

(Continued)

FOREIGN PATENT DOCUMENTS

| | | |
|---|---|---|
| DE | 738391 | 8/1943 |
| EP | 143618 | 7/1988 |

(Continued)

OTHER PUBLICATIONS

ASTM Designation D5342-97: Resistance to Bending of Paper and Paperboard (Taber-Type Tester in Basic Configuration).

(Continued)

*Primary Examiner* — Valerie L Woodward

(57) ABSTRACT

A filtering face-piece respirator that has a harness and a mask body where the mask body includes a filtering structure and a support structure. An exhalation valve is attached to the mask body and includes a valve seat that is integral to the mask body. The present invention is beneficial in that it eliminates the need to separately manufacture some or all of the non-dynamic parts of the exhalation valve. There also is no need to subsequently attach the valve seat to the mask body.

23 Claims, 4 Drawing Sheets

(56) References Cited

U.S. PATENT DOCUMENTS

| | | | | | |
|---|---|---|---|---|---|
| 3,276,445 | A | * | 10/1966 | Langdon | A62B 23/025 128/206.15 |
| 3,521,630 | A | * | 7/1970 | Westberg | A62B 23/025 128/206.15 |
| 4,248,220 | A | | 2/1981 | White | |
| 4,300,549 | A | | 11/1981 | Parker | |
| D267,985 | S | | 2/1983 | Huber | |
| 4,536,440 | A | | 8/1985 | Berg | |
| 4,573,464 | A | * | 3/1986 | Yo | A62B 18/10 128/206.15 |
| 4,576,196 | A | | 3/1986 | Ross et al. | |
| D285,374 | S | | 8/1986 | Huber et al. | |
| 4,630,604 | A | * | 12/1986 | Montesi | A62B 18/025 128/206.15 |
| 4,657,010 | A | | 4/1987 | Wright | |
| 4,739,755 | A | * | 4/1988 | White | A62B 18/02 128/206.12 |
| 4,790,306 | A | | 12/1988 | Braun et al. | |
| 4,807,619 | A | | 2/1989 | Dyrud et al. | |
| 4,850,347 | A | | 7/1989 | Skov | |
| 4,873,972 | A | | 10/1989 | Magidson et al. | |
| 4,951,664 | A | | 8/1990 | Niemeyer | |
| 5,050,594 | A | | 9/1991 | Babb | |
| 5,094,236 | A | | 3/1992 | Tayebi | |
| 5,174,731 | A | | 12/1992 | Korver | |
| D347,298 | S | | 5/1994 | Japuntich et al. | |
| D347,299 | S | | 5/1994 | Bryant et al. | |
| 5,325,892 | A | | 7/1994 | Japuntich et al. | |
| 5,331,957 | A | | 7/1994 | Liu | |
| 5,509,436 | A | | 4/1996 | Japuntich et al. | |
| 5,673,690 | A | | 10/1997 | Tayebi et al. | |
| 6,041,782 | A | | 3/2000 | Angadjivand et al. | |
| 6,047,698 | A | * | 4/2000 | Magidson | A62B 18/10 128/205.24 |
| 6,125,849 | A | | 10/2000 | Williams et al. | |
| 6,142,177 | A | | 11/2000 | Jones | |
| 6,394,090 | B1 | | 5/2002 | Chen et al. | |
| 6,474,336 | B1 | | 11/2002 | Wolfe | |
| 6,484,722 | B2 | | 11/2002 | Bostock et al. | |
| RE37,974 | E | | 2/2003 | Bowers | |
| 6,568,392 | B1 | | 5/2003 | Bostock et al. | |
| 6,604,524 | B1 | | 8/2003 | Curran et al. | |
| 6,824,117 | B2 | | 11/2004 | Horton | |
| 6,843,248 | B2 | | 1/2005 | Japuntich et al. | |
| 6,854,463 | B2 | | 2/2005 | Japuntich et al. | |
| 6,883,518 | B2 | | 4/2005 | Mittelstadt et al. | |
| 6,923,182 | B2 | | 8/2005 | Angadjivand et al. | |
| 6,959,709 | B2 | | 11/2005 | Curran et al. | |
| 6,986,365 | B2 | | 1/2006 | Henning et al. | |
| 7,007,695 | B2 | | 3/2006 | Curran et al. | |
| 7,013,895 | B2 | | 3/2006 | Martin et al. | |
| 7,028,689 | B2 | * | 4/2006 | Martin | A62B 18/10 128/205.24 |
| 7,028,981 | B2 | | 4/2006 | Horton | |
| 7,069,931 | B2 | | 4/2006 | Curran et al. | |
| 7,117,868 | B1 | | 10/2006 | Japuntich et al. | |
| 7,121,279 | B2 | | 10/2006 | Denis | |
| 7,131,442 | B1 | | 11/2006 | Kronzer et al. | |
| RE39,493 | E | | 2/2007 | Yuschak et al. | |
| 7,188,622 | B2 | | 3/2007 | Martin et al. | |
| 7,726,314 | B1 | * | 6/2010 | Ming | A61M 16/06 128/202.27 |
| D629,885 | S | | 12/2010 | Skulley et al. | |
| 8,066,006 | B2 | | 11/2011 | Daugaard et al. | |
| D657,449 | S | | 4/2012 | Johnson | |
| 2003/0029454 | A1 | | 2/2003 | Gelinas | |
| 2003/0205231 | A1 | | 11/2003 | Shigematsu et al. | |
| 2005/0098183 | A1 | | 5/2005 | Nash | |
| 2007/0039620 | A1 | | 2/2007 | Sustello | |
| 2007/0215160 | A1 | * | 9/2007 | Viljanen | A41D 13/11 128/206.15 |
| 2009/0078261 | A1 | | 3/2009 | Martin et al. | |
| 2009/0078262 | A1 | | 3/2009 | Gebrewold et al. | |
| 2009/0078265 | A1 | | 3/2009 | Gebrewold et al. | |
| 2009/0078266 | A1 | | 3/2009 | Stepan et al. | |
| 2009/0090364 | A1 | | 4/2009 | Daugaard et al. | |
| 2009/0235934 | A1 | | 9/2009 | Martin | |
| 2012/0042878 | A1 | | 2/2012 | Woo | |

FOREIGN PATENT DOCUMENTS

| | | |
|---|---|---|
| EP | 1495785 | 1/2005 |
| EP | 1820541 | 8/2007 |
| GB | 825659 | 12/1959 |
| GB | 1507257 | 4/1979 |
| GB | 2059782 | 4/1981 |
| GB | 2176404 | 12/1986 |
| GB | 2408213 | 5/2005 |
| JP | 2000-140139 | 5/2000 |
| NL | 49614 | 11/1940 |

OTHER PUBLICATIONS

MD&DI article on Insert Molding by Jim Vance [retrieved from the internet on Feb. 1, 2008] http://www.devicelink.com/grabber.php3?URL=http://www.devicelink.com/mddi/archive/96/04/010.html.

Taber Industries 150-E Instruction Manual.

U.S. Appl. No. 29/295,022 to Lovo et al., filed Sep. 20, 2007, entitled Filtering Face-Piece Respirator Nose Bridge.

Moldex 2200 Series N95 Particulate Respirators web page literature [retrieved from the internet on Jul. 19, 2007] http://www.moldex.com/disposableprod/1100n95.htm.

Moldex 2200N Series N95 Particulate Respirators product literature (Sep. 2005).

* cited by examiner

FILTERING FACE-PIECE RESPIRATOR HAVING AN INTEGRALLY-JOINED EXHALATION VALVE

The present invention pertains to a filtering face-piece respirator that uses an exhalation valve that is integrally secured to the mask body support structure.

BACKGROUND

Respirators are commonly worn over the breathing passages of a person for at least one of two common purposes: (1) to prevent impurities or contaminants from entering the wearer's breathing track; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

Some respirators are categorized as being "filtering face-pieces" because the mask body itself functions as the filtering mechanism. Unlike respirators that use rubber or elastomeric mask bodies in conjunction with attachable filter cartridges (see, e.g., U.S. Pat. No. RE39,493 to Yuschak et al.) or insert-molded filter elements (see, e.g., U.S. Pat. No. 4,790,306 to Braun), filtering face-piece respirators have the filter media comprise much of the whole mask body so that there is no need for installing or replacing a filter cartridge. As such, filtering face-piece respirators are relatively light in weight and easy to use. Examples of patents that disclose filtering face-piece respirators include U.S. Pat. No. 7,131,442 to Kronzer et al, U.S. Pat. Nos. 6,923,182 and 6,041,782 to Angadjivand et al. U.S. Pat. Nos. 6,568,392 and 6,484,722 to Bostock et al., U.S. Pat. No. 6,394,090 to Chen, and U.S. Pat. No. 4,873,972 to Magidson et al.

To provide a filtering face-piece respirator that has a permanent cup-shaped configuration, the mask body is typically provided with a molded shaping layer. Molded shaping layers have been made from thermally bonded fibers or open-work filamentary meshes, which are molded into the cup-shaped configuration—see, for example, U.S. Pat. No. 4,850,347 to Skov, U.S. Pat. No. 4,807,619 to Dyrud et al., U.S. Pat. No. 4,536,440 to Berg, and U.S. Pat. No. Des. 285,374 to Huber et al. The shaping layers regularly support a filtering structure that may include an electrically-charged, nonwoven web of microfibers.

To improve wearer comfort, filtering face-piece respirators sometimes have an exhalation valve mounted to the mask body to rapidly purge the wearer's exhaled air from the mask interior; see U.S. Pat. Nos. 7,028,689, 7,188,622, and 7,013,895 to Martin et al. and U.S. Pat. Nos. 7,117,868, 6,854,463, and 6,843,248 to Japuntich et al., and U.S. Pat. No. RE37,974 to Bowers. The quick removal of exhaled air from the mask interior improves wearer comfort.

Exhalation valves have been mounted to respirator mask bodies using a variety of techniques. In some respirators, the valve is welded directly to the various layers that comprise the mask body. In other constructions, the valve seat is clamped to the mask body; see U.S. Pat. Nos. 7,069,931, 7,007,695, 6,959,709, and 6,604,524 to Curran et al. Additionally, a printed patch of adhesive has been used to secure the exhalation valve to the mask body; see U.S. Pat. No. 6,125,849 to Williams et al. In each of these various techniques, the valve is made separately from the mask body and is subsequently attached to the fibrous media and/or open-work filamentary mesh that comprises the mask body.

SUMMARY OF THE INVENTION

The present invention provides a new construction for securing an exhalation valve to the mask body of a filtering face-piece respirator. In so doing, the present invention provides a filtering face-piece respirator that comprises: (a) a harness; (b) a mask body that comprises: (i) a filtering structure; (ii) a support structure; and (c) an exhalation valve that comprises a valve seat that is integral to the support structure.

As indicated above, conventional filtering face-piece respirators have secured the separately-constructed exhalation valve directly to the fibrous and open-work plastic structures of the mask body. The present invention makes the exhalation valve seat at the same time as the support structure and, as such, eliminates these additional manufacturing steps. In the present invention, there is no need to separately manufacture the valve seat or to mount the valve seat to the mask body.

Because mask bodies for conventional filtering face-piece respirators have regularly used shaping layers that comprised molded nonwoven webs of thermally-bonded fibers or an open-work filamentary mesh to provide structural integrity to the mask body, the ability to provide an exhalation valve integral to the mask body was lacking In one embodiment, the present invention provides a mask body support structure that has one or more cross members that allow the valve seat to be firmly part of the mask body. The valve seat can be integrally attached to one or more cross members to provide a new and improved support structure.

GLOSSARY

The terms set forth below will have the meanings as defined:

"bisect(s)" means to divide into two generally equal parts;

"centrally spaced" means separated significantly from one another along a line or plane that bisects the mask body;

"comprises (or comprising)" means its definition as is standard in patent terminology, being an open-ended term that is generally synonymous with "includes", "having", or "containing" Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"contaminants" means particles (including dusts, mists, and fumes) and/or other substances that generally may not be considered to be particles (e.g., organic vapors, bacteria, et cetera) but which may be suspended in air, including air in an exhale flow stream;

"cross member" means a solid part that extends at least partially across (transversely (side-to-side) or longitudinally (vertically))the mask body;

"crosswise dimension" is the dimension that extends laterally across the respirator from side-to-side when the respirator is viewed from the front;

"exhalation valve" means a valve that opens to allow exhaled air to exit a filtering face mask's interior gas space;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges or inserted-molded filter elements attached to or molded into the mask body to achieve this purpose;

"filter" or "filtration layer" means one or more layers of air-permeable material, which layer(s) is adapted for the primary purpose of removing contaminants from an air stream that passes through it;

"filtering structure" means a construction that is designed primarily for filtering air;

"first side" means an area of the mask body that is laterally distanced from a plane that bisects the mask vertically and that would reside in the region of a wearer's cheek and/or jaw when the respirator is being donned;

"flexible flap" means a sheet-like article that is capable of bending or flexing in response to a force exerted from an exhale gas stream;

"harness" means a structure or combination of parts that assists in supporting the mask body on a wearer's face;

"hinder movement" means to deprive of significant movement when exposed to forces that exist under normal use conditions;

"integral" means being manufactured together at the same time—that is, being made together as one part and not two separately manufactured parts that are subsequently joined together;

"interior gas space" means the space between a mask body and a person's face;

"line of demarcation" means a fold, seam, weld line, bond line, stitch line, hinge line, and/or any combination thereof;

"living hinge" means a mechanism that allows members that extend therefrom to generally pivot thereabout in a rotational-type manner with such ease that damage is not caused to the members or to the hinge joint under normal use;

"mask body" means an air-permeable structure that is designed to fit over the nose and mouth of a person and that helps define an interior gas space separated from an exterior gas space;

"perimeter" means the outer edge of the mask body, which outer edge would be disposed generally proximate to a wearer's face when the respirator is being donned by a person;

"pleat" means a portion that is designed to be folded back upon itself;

"pleated" means being folded back upon itself;

"polymeric" and "plastic" each mean a material that mainly includes one or more polymers and may contain other ingredients as well;

"plurality" means two or more;

"respirator" means an air filtration device that is worn by a person to provide the wearer with clean air to breathe;

"rigid" means the part does not readily deform substantially and easily in response to mere pressure from a person's finger.

"seal surface" means a surface onto which the flexible flap makes contact when the valve is in its closed position;

"second side" means an area of the mask body that is distanced from a plane line that bisects the mask vertically (the second side being opposite the first side) and that would reside in the region of a wearer's cheek and/or jaw when the respirator is being donned;

"support structure" means a construction that is designed to have sufficient structural integrity to retain its desired shape and to help retain the intended shape of the filtering structure that is supported by it, under normal handling;

"spaced" means physically separated or having measurable distance therebetween;

"transversely extending" means extending generally in the crosswise dimension;

"valve base" means the portion of the exhalation valve that includes the seal surface and that is joined to the mask body; and "valve seat" means the portion of the exhalation valve that includes the seal surface and the valve base.

DETAILED DESCRIPTION OF PREFERRED EMBODIMENTS

In practicing the present invention, a filtering face-piece respirator is provided that has an exhalation valve seat that is integral to the support structure of the mask body. Rather than mount the valve seat to a shaping layer that comprises thermally-bonded fibers or an open-work plastic mesh, the present invention integrally joins the valve seat to the support structure itself. When the valve seat is integrally joined to the support structure, there is no need to separately manufacture the valve seat or to mechanically secure it to the mask body.

Figure 1:
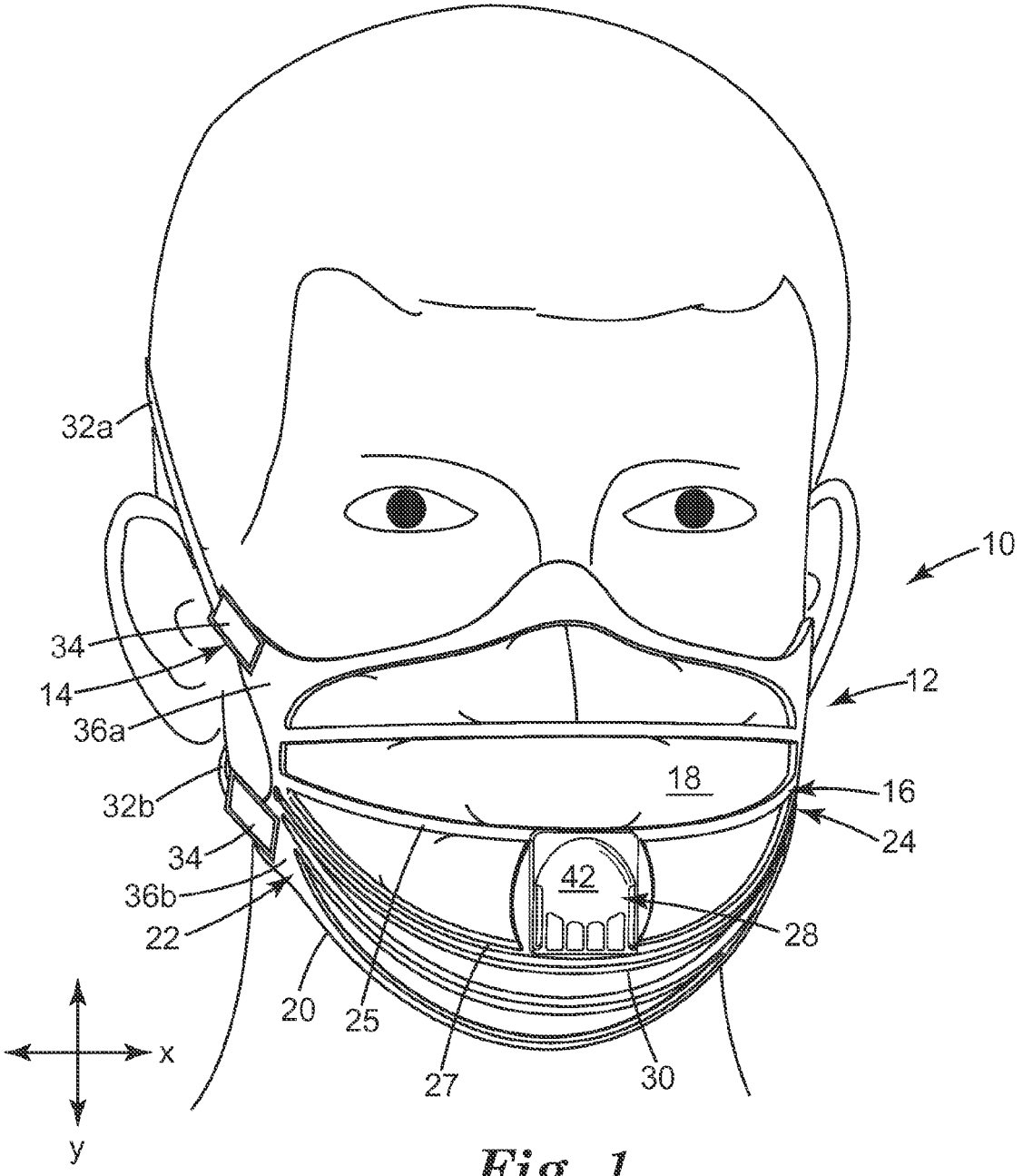
FIG. 1 shows a front perspective view of a filtering face-piece respirator 10, in accordance with the present invention, being worn on a person's face.

FIG. 1 shows an example of a shaped filtering face-piece respirator 10 that may be used in accordance with the present invention. As illustrated, the filtering face-piece respirator 10 includes a mask body 12 and a harness 14. The mask body 12 has a support structure 16 and a filtering structure 18. The support structure 16 includes a perimeter 20, a first side 22, and an opposing second side 24. The perimeter 20 of the support structure 16 may, but not necessarily, contact the wearer's face when the respirator 10 is being donned. The perimeter 20 may comprise a member, or combination of members, that extend 360° continuously about, and adjacent to, the periphery of the mask body 12. Typically, the wearer's face will contact only the inner surface or periphery of the filtering structure 18—or an additional face seal material—so that a comfortable fit is achieved. Thus, the peripheral edge of the filtering structure 18 may extend slightly radially beyond the support structure perimeter 20. The mask body 12 also may include cross members 25 and 27 that transversely extend across the mask body 12. As illustrated, these transversely-extending cross members 25 and 27 extend from a first side 22 of the respirator to a second side 24. The invention, however, contemplates embodiments where the cross members do not need to extend fully across the mask body 12 but extend only partially across it. The use of cross members that extend from a first side 22 to a second side 24 may provide a support structure 16 that has very good structural stability and therefore may be preferred in conjunction with the present invention but may not be necessary for providing a structure onto which an exhalation valve 28 may be integrally secured. The cross members also could, for example, extend partially or fully across the mask body 12 in the longitudinal direction. To readily fashion the valve 28 or portions thereof at the same time as, or "integral" with, the support structure 16, the support structure 16 may comprise a plurality of cross members that help define the mask body shape, while at the same time support the valve 28 and the filtering structure 18.

The support structure 16 also may include a longitudinally-movable, transversely-extending member 30. This longitudinally-movable, transversely-extending member 30 can extend from a first side 22 of the mask body 12 to a second side 24, preferably without being joined together between sides 22 and 24 by any longitudinally-extending member(s) that could hinder movement of the transversely-extending members 30 in a longitudinal direction. That is, there preferably is no structural member that joins member 30 to member 27 so as to restrict member 30 from moving away from member 27 when the wearer expands their jaw or opens their mouth. When viewing the respirator as projected onto a plane from the front, the transverse direction is the direction that extends across the respirator in the general "x" direction, and the longitudinal direction is the dimension that extends between the bottom and top of the respirator 10 in the general "y" direction. When viewed through such a planar projection, the transversely-extending member 30 can move towards and away from member 27 in the general "y" direction. The use of a longitudinally-movable member 30 may allow the mask body 12 to expand to better accommodate wearer jaw movement and various sized faces—see U.S. patent application Ser. No. 60/974,025 entitled Filtering Face-Piece Respirator That Has Expandable Mask Body, filed on Sep. 20, 2007.

The respirator 10 is supported on the face of the wearer by a harness 14 that may include first and second straps 32*a* and 32*b*. These straps 32*a*, 32*b* may be adjusted in length by one or more buckles 34. The buckles 34 may be secured to the mask body 12 at the first and second sides 22, 24 at harness-securement flange members 36*a*, 36*b* using a variety of methods, including stapling, adhesive bonding, welding, and the like. The buckles 34 also may be integrally molded into the support structure 16; see, U.S. patent application U.S. Ser. No. 60/974,031 entitled Filtering Face-Piece Respirator Having Buckles Integral To The Mask Body, filed on Sep. 20, 2007. The thickness of the harness flanges 36*a*, 36*b* typically may be about 2 to 3 mm.

Figure 2A:
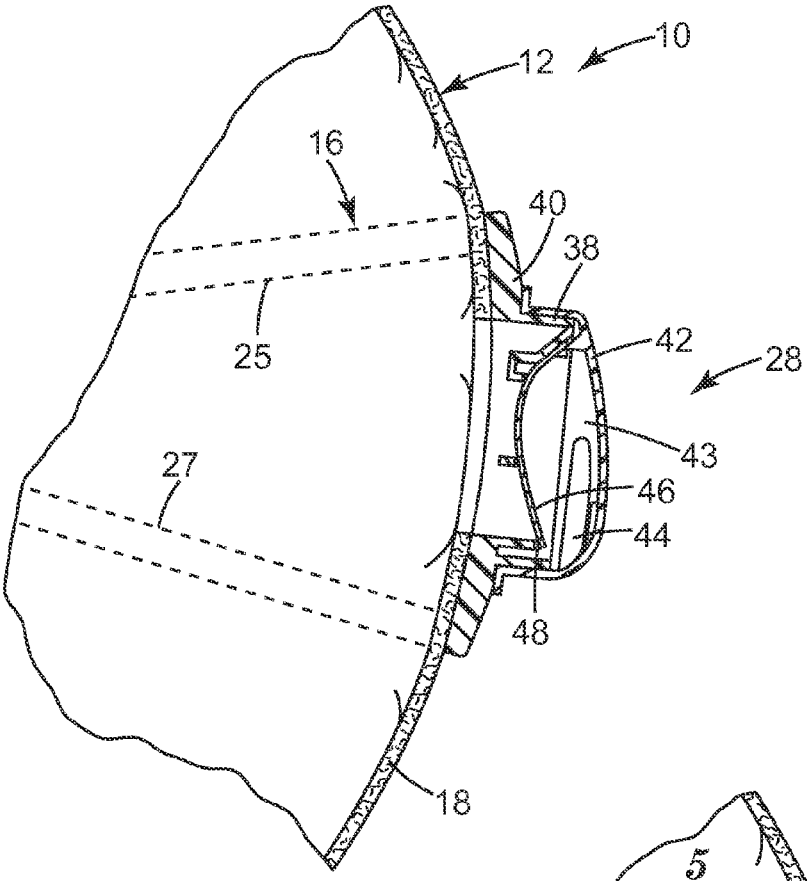
FIGS. 2*a* and 2*b* are cross-sectional views of an exhalation valve 28 integrally secured to a support structure 16 in accordance with the present invention.
Figure 2B:
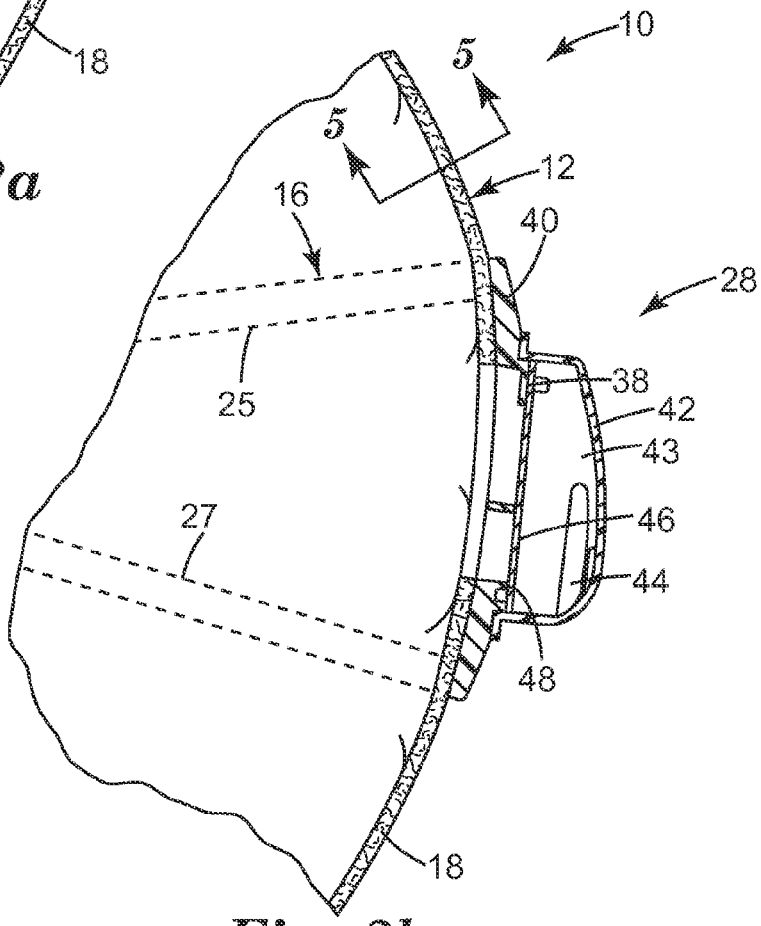

FIGS. 2*a* and 2*b* show the exhalation valve 28 secured to the support structure 16 at the valve seat 38 in cross-section. The valve seat 38 includes a valve base 40 that is integrally joined to the support structure 16 at cross members 25 and 27. The exhalation valve 28 also has a valve cover 42 that resides over the valve seat 38 to define an air chamber 43 through which exhaled air passes before exiting the valve 28 at valve cover opening(s) 44. The exhalation valve 28 also has a flexible flap 46 that lifts from a seal surface 48 in response to exhalation pressure generated by a respirator wearer during an exhalation. In FIG. 2*a*, the valve seat has a curved seal surface 48, whereas in FIG. 2*b* the seal surface is generally planar when viewed from the side. The flap may be made from known flexible materials (see, e.g., U.S. Pat. No. 6,854,463 to Japuntich et al. and U.S. Pat. No. 7,028,689 to Martin et al.) and may take on a variety of sheet-like shapes (see, e.g., U.S. Pat. No. 6,883,518 to Mittelstadt et al.).

Figure 3:
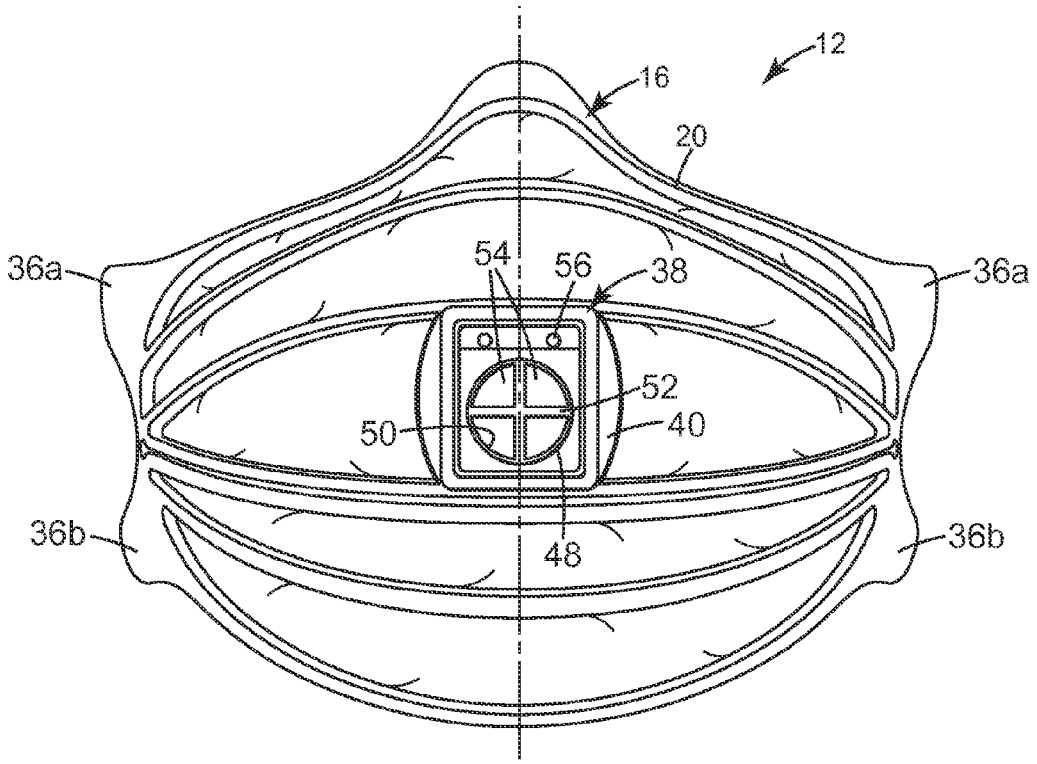
FIG. 3 is a front view of a mask body 12 that has a valve seat 38 integral to a support structure 16 in accordance with the present invention.

FIG. 3 shows a front view of a mask body 12 where the valve cover (42, FIGS. 2*a* and 2*b*) and the flexible flap (46, FIGS. 2*a* and 2*b*) have been removed so that the valve seat 38 is more visible. As shown, the valve seat 38 includes a seal surface 48 and an aperture 50. Although the seal surface 48 and aperture 50 are both illustrated as being circular, they may independently take on a variety of other configurations including rectangular, elliptical, etc. The aperture 50 allows exhaled air to pass from the interior gas space through the valve to ultimately enter the exterior gas space. When viewed from the front as shown in FIG. 3, the seal surface 48 surrounds the aperture 50. One or more orifice dividers 52 may be employed within the aperture 50 to provide a plurality of openings 54 within the whole aperture 50. One or more valve posts 56 or other means may be provided in the valve seat 38 to allow for the proper alignment of the flexible flap (46, FIGS. 2*a* and 2*b*) when secured to the valve seat 38.

Exhalation valves that are integrally attached to the support structure in accordance with the present invention may have a construction similar to the unidirectional valves described in U.S. Pat. Nos. 7,188,622, 7,028,689, and 7,013,895 to Martin et al.; U.S. Pat. Nos 7,117,868, 6,854,463, 6,843,248, and 5,325,892 to Japuntich et al.; U.S. Pat. No. 6,883,518 to Mittelstadt et al.; and U.S. Pat. No. RE37,974 to Bowers. A valve cover also can be molded integral to the valve seat in a hinged manner such that it only needs to be rotated into engagement with the valve seat to be fully secured thereto by frictional and/or mechanical or adhesive fasteners—see U.S. Pat. No. 6,047,698. Examples of valve cover designs are shown in U.S. Pat. Nos Des. 347,298 to Japuntich et al. and U.S. Pat. No. Des. 347,299 to Bryant et al. Essentially any exhalation valve that provides a suitable pressure drop and that can be integrally secured to the support structure may be used in connection with the present invention.

The valve base typically is sized to encompass an area (measured from its outer dimensions), when viewed from the front, that is less than about 25 square centimeters ($cm^2$). More typically, the base is sized to encompass an area typically less than about 16 $cm^2$. When a flapper or cantilevered-style valve is used (see, for example, U.S. Pat. No. 5,509,436 to Japuntich et al., and U.S. Pat. No. 6,047,698 to Magidson et al.), the valve base may be longer in the longitudinal dimension than in the cross-wise dimension. Typically, the members that comprise the base are less than 1 cm thick. The thickness of the base member(s) typically is greater than 2 mm and is less than 5 mm. More typically, the thickness of the base member(s) is about 2 to 4 mm. The valve base typically occupies an area of about 2 to 10 $cm^2$, more typically about 3 to 7 $cm^2$. The base preferably extends continuously 360° about an opening in the mask body. The mask body opening, and hence the valve seat, preferably are located directly in front of where the wearer's mouth would be when the respirator is being donned. The thickness of the cross-members of the support structure may be about 0.25 to 5 mm, more typically about 1 to 3 mm. The thickness of the harness flanges 36*a*, 36*b* typically may be about 2 to 3 mm.

The valve seat and/or support structure may be made by known techniques such as injection molding. Known plastics such as olefins including, polyethylene, polypropylene, polybutylene, and polymethyl(pentene); plastomers; thermoplastics; thermoplastic elastomers; and blends thereof may be used to make the frame and/or support structure. Additives such as pigments, UV stabilizers, anti-block agents, nucleating agents, fungicides, and bactericides also may be added to the composition that forms the frame and/or support structure. The plastic typically exhibits a stiffness in flexure of about 75 to 300 Mega Pascals (MPa), more typically about 100 to 250 MPa, and still typically about 175 to 225 MPa. A metal or ceramic material also may be used in lieu of plastic to construct the valve seat and/or support structure, although a plastic may be preferred for disposal/cost/flexibility reasons.

A plastic used for the valve seat and/or support structure can be selected to exhibit resilience, shape memory, and resistance to flexural fatigue so that the support structure can be deformed many times (i.e. greater than 100), particularly at any hinge points, and return to its original position. The plastic selected should be able to withstand an indefinite number of deformations so that the support structure exhibits a greater service life than the filter structure. The support structure is a part or assembly that is not integral to (or made together with) the filtering structure and comprises members that are sized to be larger than the fibers used in the filtering structure. The support structure members may be rectangular, circular, triangular, elliptical, trapezoidal, etc., when viewed in cross-section. The valve seat preferably is rigid in structure so that the seal surface maintains its desired configuration. Although the valve seat desirously is rigid in structure, the cross members onto which the valve seat is joined may be sufficiently flexible to enable the mask body to conform to the wearer's face and to allow it to return to its desired configuration when deformed from, for example, striking another object during use.

Figure 4:
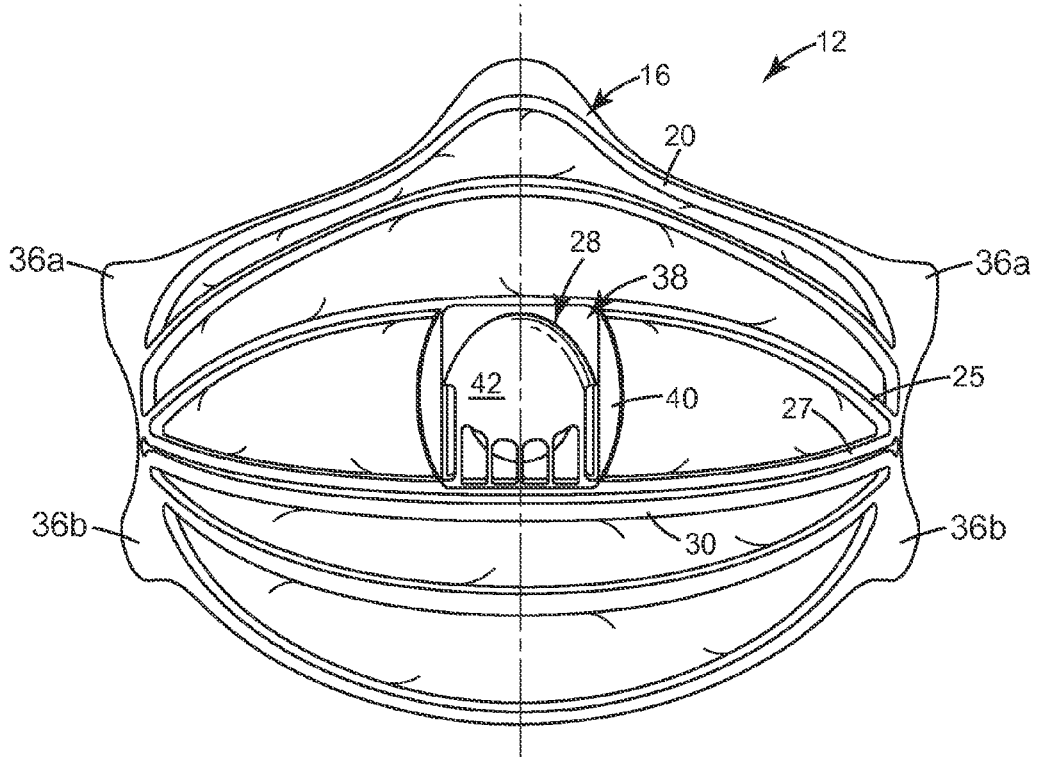
FIG. 4 is a front view of a mask body 12 that has an exhalation valve 28 integrally joined to the support structure 16 at the valve seat 38.

FIG. 4 shows that a valve cover 42 may be placed over the valve seat 38. The valve cover 42 may be integrally joined to the valve seat along one edge in a hinged manner or may be glued, welded, mechanically joined, or secured thereto by a combination of such means. The valve cover and the valve seat therefore may be made as a single part. Examples of valve covers that may be used are shown in U.S. Pat. Nos. Des. 347,298 and Des. 347,299. The valve cover may include one or more surfaces that mechanically secure the flexible flap to the valve seat 38. The valve cover may be made from similar or different materials than the valve seat but typically will be made from the same rigid plastic.

Figure 5:
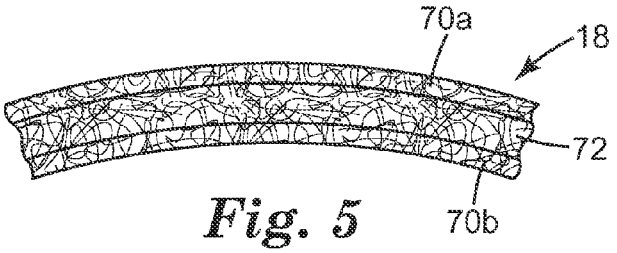
FIG. 5 is a cross-sectional view taken along lines 5-5 of FIG. 2*b* through the filtering structure 18, which may be used in a mask body 12 of the present invention.

FIG. 5 shows a cross-section of an example of a filtering structure 18 that may be used in connection with the present invention. As illustrated, the filtering structure 18 may include one or more cover webs 70*a* and 70*b* and a filtration layer 72. The cover webs 70*a* and 70*b* may be located on opposing sides of the filtration layer 72 to capture any fibers that could come loose therefrom. Typically, the cover webs 70*a* and 70*b* are made from a selection of fibers that provide a comfortable feel, particularly on the side of the filtering structure 18 that makes contact with the wearer's face. The construction of various filter layers and cover webs that may be used in conjunction with the support structure of the present invention are described below in more detail.

Figure 6:
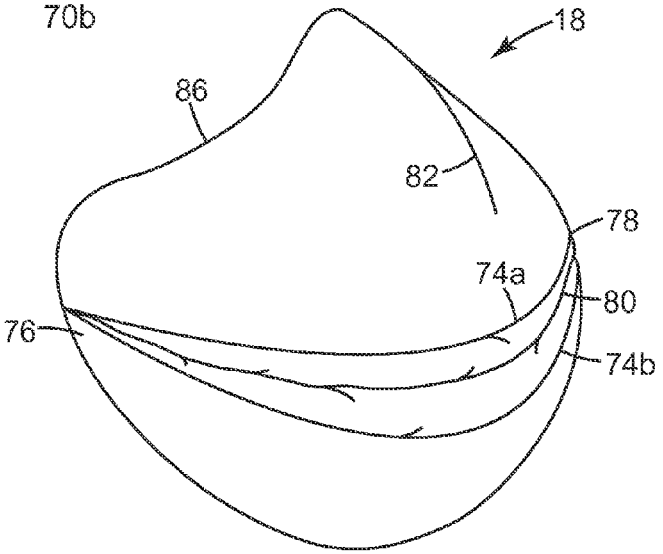
FIG. 6 is a perspective view of a filtering structure 18 that may be used in a mask body of the present invention.

FIG. 6 shows a perspective view of one example of a filtering structure 18 that can be used in a respirator of the present invention. The filtering structure 18 may include a first and second transversely-extending lines of demarcation 74*a* and 74*b*. These lines of demarcation 74*a*, 74*b* may be substantially spaced from one another in the central portion of the filtering structure 18 but may converge towards each other, moving laterally in the direction of the sides 76 and 78. The lines of demarcation 74*a*, 74*b* may comprise a fold, weld line, stitch line, bond line, hinge line, or combination thereof. Generally, the first and second lines of demarcation 74*a* and 74*b* correspond to the location of certain cross members on the support structure. When the first and second lines of demarcation 74*a*, 74*b* define a pleat 80 that may be formed therebetween, the first and second lines of demarcation 74*a*, 74*b* preferably are secured to transversely-extending members 27 and 30, respectively, thereby allowing the filtering structure to open and close in an accordion-like manner about the pleat 80 that is located therebetween. The filtering structure 18 also includes a generally vertical line of demarcation 82 that may be provided in the nose region of the filtering structure to eliminate excess material that would otherwise accumulate in the nose region during the manufacturing process. Although the filtering structure 18 has been illustrated with only a single pleat 80, the filtering structure 18 may include two or more of such pleats in the cross-wise dimension. Under such circumstances, it is preferable to provide a support structure that has multiple living hinges where the movable transversely-extending members meet. To improve fit and wearer comfort, an elastomeric face seal can be secured to the perimeter 86 of the filtering structure 18. Such a face seal may extend radially inward to contact the wearer's face when the respirator is being donned. The face seal may be made from a thermoplastic elastomer. Examples of face seals are described in U.S. Pat. No. 6,568,392 to Bostock et al., U.S. Pat. No. 5,617,849 to Springett et al., U.S. Pat. No. 4,600,002 to Maryyanek et al., and in Canadian Patent 1,296,487 to Yard.

The filtering structure may take on a variety of different shapes and configurations. The filtering structure typically is adapted so that it properly fits against or within the support structure. Generally the shape and configuration of the filtering structure corresponds to the general shape of the support structure. The filtering structure may be disposed radially inward from the support structure, it may be disposed radially outward from the support structure, or it may be disposed between various members that comprise the support structure. Although a filtering structure has been illustrated with multiple layers that include a filtration layer and two cover webs, the filtering structure may simply comprise a filtration layer or a combination of filtration layers. For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors. The filtering structure may include one or more stiffening layers that allow such a cup-shaped configuration to be maintained. Alternatively, the filtering structure could have one or more horizontal and/or vertical lines of demarcation that contribute to its structural integrity to help maintain the cup-shaped configuration.

The filtering structure that is used in a mask body of the invention can be of a particle capture or gas and vapor type filter. The filtering structure also may be a barrier layer that prevents the transfer of liquid from one side of the filter layer to another to prevent, for instance, liquid aerosols or liquid splashes from penetrating the filter layer.

Multiple layers of similar or dissimilar filter media may be used to construct the filtering structure of the invention as the application requires. Filters that may be beneficially employed in a layered mask body of the invention are generally low in pressure drop (for example, less than about 195 to 295 Pascals at a face velocity of 13.8 centimeters per second) to minimize the breathing work of the mask wearer. Filtration layers additionally are flexible and have sufficient shear strength so that they generally retain their structure under expected use conditions. Examples of particle capture filters include one or more webs of fine inorganic fibers (such as fiberglass) or polymeric synthetic fibers. Synthetic fiber webs may include electret charged polymeric microfibers that are produced from processes such as meltblowing. Polyolefin microfibers formed from polypropylene that has been electrically charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures—see U.S. Pat. No. 3,971,373 to Braun. A sorbent layer can be formed by coating a substrate, such as fibrous or reticulated foam, to form a thin coherent layer. Sorbent materials may include activated carbons that are chemically treated or not, porous alumina-silica catalyst substrates, and alumina particles. An example of a sorptive filtration structure that may be conformed into various configurations is described in U.S. Pat. No. 6,391,429 to Senkus et al.

The filtration layer is typically chosen to achieve a desired filtering effect and, generally, removes a high percentage of particles and/or or other contaminants from the gaseous stream that passes through it. For fibrous filter layers, the fibers selected depend upon the kind of substance to be filtered and, typically, are chosen so that they do not become bonded together during the molding operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other means. Essentially any suitable material that is known (or later developed) for forming a filtering layer may be used for the filtering material. Webs of melt-blown fibers, such as those taught in Wente, Van A., *Superfine Thermoplastic Fibers,* 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles,* Institution Of Mechanical Engineers, London, Proceedings 1B, 1952. Particularly preferred are BMF webs that contain fibers formed from polypropylene, poly(4-methyl-1-pentene), and combinations thereof. Electrically charged fibrillated-film fibers as taught in van Turnhout, U.S. Pat. No. Re. 31,285, may also be suitable, as well as rosin-wool fibrous webs and webs of glass fibers or solution-blown, or electrostatically sprayed fibers, especially in microfilm form. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydrocharging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847 B1, 6,397,458 B1, and 6,409,806 B1 to Jones et al. Typical basis weights for electret BMF filtration layers are about 10 to 100 grams per square meter. When electrically charged according to techniques described in, for example, the '507 patent, and when including fluorine atoms as mentioned in the Jones et al. patents, the basis weight may be about 20 to 40 g/m$^2$ and about 10 to 30 g/m$^2$, respectively.

An inner cover web can be used to provide a smooth surface for contacting the wearer's face, and an outer cover web can be used to entrap loose fibers in the mask body or for aesthetic reasons. The cover web typically does not provide any substantial filtering benefits to the filtering structure, although it can act as a pre-filter when disposed on the exterior (or upstream to) the filtration layer. To obtain a suitable degree of comfort, an inner cover web preferably has a comparatively low basis weight and is formed from comparatively fine fibers. More particularly, the cover web may be fashioned to have a basis weight of about 5 to 50 g/m$^2$ (typically 10 to 30 g/m$^2$), and the fibers are less than 3.5 denier (typically less than 2 denier, and more typically less than 1 denier but greater than 0.1). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web are blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum. Spun-bond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 g/m$^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 g/m$^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention preferably have very few fibers protruding from the web surface after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

EXAMPLE

Test Methods

1. Stiffness in Flexure Test (SFT)

The stiffness in flexure of material used to make the support structure was measured according to ASTM D 5342-97 section 12.1 to 12.7. In so doing, six test specimens were cut from a blank film into rectangular pieces that were about 25.4 mm wide by about 70 mm long. The specimens were prepared as described below. Taber V-5 Stiffener tester Model 150-E (from Taber Corporation, 455 Bryant Street, North Tonawanda, N.Y., 14120) was used in 10-100 Taber stiffness unit configurations to measure the test specimens. The Taber Stiffness readings were recorded from the equipment display at the end of the test, and the stiffness in flexure was calculated using the following equation:

$$\text{Stiffness in Flexure (Pa)} = 7{,}492\frac{Ncm^4}{M^2}\left(\frac{\text{Tabar Stiffness}}{\text{Width} * \text{thickness}^3}\right)$$

Taber Stiffness=recorded material resistance to bending measured according to ASTM D5342-97 section 12.1 to 12.7.

Width=width of test film specimen in cm, which was 2.54 cm.

Thickness=average thickness of test specimen in cm measured using standard digital caliper at five equally-spaced locations along the length, of the material.

The stiffness in flexure from the six samples were averaged to give the Stiffness in Flexure.

Sample Preparation

1. Stiffness in Flexure Test Specimen

Test specimens for the Stiffness in Flexure Test can be prepared from the same compounded polymer ingredients that can be blended together to make the respirator support structure. See Table 2 for an example of the polymeric composition of the support structure. Forty (40) grams of the compound were used to make a circular film that was 114 mm in radius and 0.51 to 0.64 mm thick. The first 40 grams of the compounded material was poured into a twin screw roller blade Type Six BRABENDER mixer (from C.W. Brabender instruments Inc., 50 East Wesley Street, P.O. Box 2127, South Hackensack, N.J., 07606). The mixer was operating at 75 revolutions per minute (RPM) and at a temperature of 185° C. After blending the molten compound for about 10 minutes, the mixture was pressed under 44.5 kilonewtons (KN) of force to make the 0.51 to 0.64 mm thick flat circular film that was 114 mm in diameter. The compression was conducted using a hot platen set at 149 ° C. The hot platen was a Genesis 30 ton Compression molding press from WABASH Equipments 1569 Morris Street, P.O. Box 298, Wabash, Ind. 46992. Before testing for stiffness in flexure, the films were cut to the required test specimen sizes of 25.4 mm wide by 70 mm long.

2. Respirator Support Structure Manufacture

Samples of the respirator support structure can be made using a standard injection molding process. Single cavity male and female molds, generally matching the geometry of the support structure shown in FIGS. 1, 3, and 4 can be made at a tool manufacturer. At a relaxed state, or while the support structure is still on the mold, the support structure can measure 115 mm, top to bottom, and 120 mm from side to side. The measurement can be made along a direct line between the highest and lowest points on the perimeter and two living hinge points, respectively while the respirator is in an unstressed state. The targeted thickness of the members that comprise the support structure is about 2.5 millimeters. The transversely-extending members may be given a trapezoidal cross-section to allow the support structure to be more easily removed from the mold. The cross-sectional area of the transversely-extending members may range from about 7.5 to 12 mm$^2$. The valve seat can be integrally joined to the support structure at the centrally-located cross members through use of a mold that makes the support structure and valve seat contemporaneously.

A 110 Ton Toshiba VIS-6 molding press can be used during the injection molding process to make the support structure under the conditions and set points shown in Table 1:

TABLE 1

Respirator Support Structure Injection Molding Conditions

| Process Condition | Set Point | Unit |
|---|---|---|
| Cycle time | 40 | Sec |
| Injection time | 3 | Sec |
| Fill Time | 0.86 | Sec |
| Charge Time | 1-2 | Sec |
| Cooling Time | 12 | Sec |
| Injection Pressure | 276 | MPa |
| Barrel temperature (nozzle, front, center and rear) | 204 | Degree C. |

A compounding of polymers listed in Table 2 below at the specified weight percentages can be mixed to obtain the desired physical properties of the support structure.

TABLE 2

| Support Structure Composition | | | |
|---|---|---|---|
| Weight % | Tradename | Material Type | Supplier |
| 39.72% | Engage 8490 | Polyolefin Elastomer: ethylene-octene copolymer | Dupont Dow Elastomers L.L.C., Bellvue Park Corporate Center, 300 Bellevue Parkway, Wilmington, DE 19809 |
| 39.72% | Hypel PELLD 20 | Linear Low Density Polyethylene | Entec Polymers L.L.C., 2301 Maitland Center Parkway, Suite 240, Maitland, FL 32751 |
| 14.02% | Kraton G1657 | Thermoplastic Elastomer: styrene-ethylene-butylene-styrene block copolymer | Kraton Polymers LLC, 700 Milma, North Tower, 13$^{th}$ Floor, Houston, TX 77002 |
| 0.93% | Atmer 1753 | Erucamide | Unichema North America, 4650 South Racine Avenue, Chicago, IL 60609-3321 |
| 5.61% | Silver Pigment | Pigment | Clariant Masterbatches, 9101 International Parkway, Minneapolis, MN 55428 |
| | UN 5001 Omnicolor Blue Dye* | Pigment | Clariant Masterbatches, 17 Holden Industrial park Holden, MA 01520 |

*Comprised less than 1 wt. % of the total composition.

3. Respirator Filtering Structure Manufacture

Respirator filtering structures were formed from two layers of nonwoven fibrous electret filter material that was 254 mm wide, laminated between one 50 grams per square meter (gsm) outer layer of white nonwoven fibrous spunbond material and one 22 gsm inner layer of white nonwoven fibrous spunbond material having the same width. Both layers of the nonwoven fibrous spunbond materials were made of polypropylene. The electret filter material was the standard filter material that is used in a 3M 8511 N95 respirator. The laminated web blank was cut into the 254 mm long pieces to form a square before being formed into a cup formation that had a three-dimension (3D) pleat extending transversely across the filtering structure.

Figure 7:
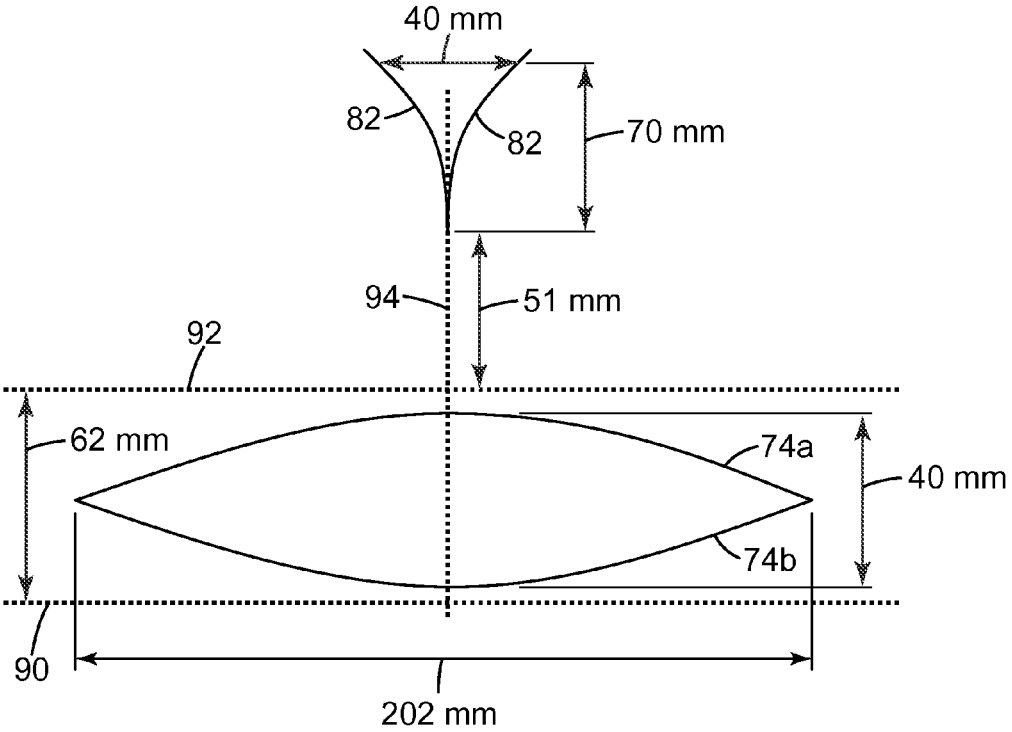
FIG. 7 is a plan view of a blank that may be used to form the filtering structure 18.

As shown in FIG. 7, where the dotted lines represent fold lines and the solid lines represent weld (or the lines of demarcation 74*a* and 74*b* in FIG. 7), the complex 3D pleat (80, FIG. 6) was formed by ultrasonically welding two curves 74*a*, 74*b* of same radius of curvature (258.5 mm radius). The distance between the highest points on each curve was 40 mm, and the two ends of the curves met at left and right end points, which were about 202 mm apart. The first curve 74 b was created by folding the laminated filter media along the first fold line 90 at least 76 mm away from one edge of laminated web. The second curve 74*a* was formed by welding along the secondary curve line by folding the laminated web at a secondary fold line 92, which is located 62 mm from the first fold line 90. Once the two curves that make the 3D pleat are formed, excess material outside of the curve lines was removed. The layered material was then folded along the vertical center line 94 and a line of demarcation 82 (FIG. 6) was welded, starting 51 mm away from the center of the second curve line as shown in FIG. 7. This step removes any excess material and forms a cup that properly fits in the respirator support structure. An ultrasonic welding process was used to make the welds. Branson 2000ae Ultrasonic welding equipment and power supply was used at a peak power mode, 100% amplitude and air pressure of 483 MPa.

4. Other Respirator Components

Face seal: Standard 3M 4000 Series respirator face seal.

Nose clip: Standard 3M 8210 Plus N 95 Respirator nose clip.

Headband: Standard 3M 8210 Plus N 95 Respirator headband material but white in color. The Yellow pigment for 3M 8210 Plus respirator headband was removed.

Buckle: A buckle similar to a back-pack buckle with flexible hinge to allow comfortable adjustment of headband material was used.

Exhalation Valve Cover: 3M Cool Flow™ valve cover from 8511 Respirator.

Exhalation Valve Flap: 3M Cool Flow™ flexible flap from an 8511 Respirator.

5. Respirator Assembly

The face seal material was cut to pieces that were about 140 mm by 180 mm. A die cut tool was then used to create an oval opening that was 125 mm by 70 mm and was located in the center of the face seal. The face seal with the central cut out opening was attached to respirator filtering structure made as described above. The same equipment that was used to ultrasonically weld the filtering element structure was used to secure the face seal to the filtering structure under similar process conditions. The welding anvil had an oval shape of about 168 mm wide and 114 mm long. After the face seal was joined to the filtering structure, excess material outside of the weld line was removed. The nose clip was adhered to the outside of the assembled filtering structure crosswise over the nose area. Then the pre-assembled filtering element was inserted into the support structure in its desired orientation. The complex 3D pleat was strategically located between transversely extending members 27 and 30 shown in FIGS. 3 and 4. A handheld Branson E-150 Ultrasonic welding equipment, at 100% output and 1.0 second weld time, was used to create attachment points between the support structure and the filtering structure at an interval of 20 to 25 mm along each transversely extending member. Four headband buckles were stapled to the harness flanges 36*a*, 36*b* using 12.7 mm Heavy Duty STANLEY staple wire on both sides of the support structure above and below the living hinge 96. A 450 mm long braided headband material was threaded through the buckles to complete the respirator assembly process. The flexible flap was placed on the valve seat, and the valve cover was placed on top of the seat such that the flap became pressed between a flap-retaining surface on the valve seat and an opposing surface on the valve cover.

Stiffness in Flexure Test Results

The compounded ingredients listed in Table 2 were selected to match desired structural and flexibility properties needed for the support structure. The calculated stiffness in flexure for the support structure material is listed in Table 3 below:

TABLE 3

Respirator Support Structure Material Stiffness in Flexure

| Specimen | Thickness (cm) | Taber Stiffness (g · cm) | Stiffness in Flexure (MPa) |
|---|---|---|---|
| 1 | 0.0627 | 14.5 | 173 |
| 2 | 0.0594 | 16.9 | 230 |
| 3 | 0.0561 | 11.9 | 199 |
| 4 | 0.0508 | 9.3 | 209 |
| 5 | 0.0546 | 11.3 | 205 |
| 6 | 0.0541 | 10.7 | 196 |
| Average | 0.0563 | 12.4 | 202 |
| Std Deviation | 0.042 | 2.8 | 18.7 |

The data set forth in Table 3 show that the Stiffness in Flexure of the support structure materials is about 200 MPa.

This invention may take on various modifications and alterations without departing from its spirit and scope. Accordingly, this invention is not limited to the above-described but is to be controlled by the limitations set forth in the following claims and any equivalents thereof.

This invention also may be suitably practiced in the absence of any element not specifically disclosed herein.

All patents and patent applications cited above, including those in the Background section, are incorporated by reference into this document in total. To the extent that there is a conflict or discrepancy between the disclosure in the incorporated document and the above specification, the above specification will control.

What is claimed is:

1. A filtering face-piece respirator that comprises:
a harness;
a mask body that comprises:
a filtering structure; and
a support structure comprising a longitudinally-movable, transversely-extending member that extends from a first living hinge disposed on a first side of the mask body to a second living hinge disposed on a second side of the mask body; and
an exhalation valve that comprises a valve seat that is integral to the support structure.

2. The filtering face-piece respirator of claim 1, wherein the support structure further comprises a plurality of spaced, cross members that extend across at least portions of the mask body, at least two of the cross members being integral to the exhalation valve.

3. The filtering face-piece respirator of claim 1, wherein the support structure includes one or more cross members, the valve seat being integral to the one or more cross members.

4. The filtering face-piece respirator of claim 3, wherein the cross members do not extend fully across the mask body.

5. The filtering face-piece respirator of claim 3, wherein the one or more cross members extend from a first side of the mask body to a second side.

6. The filtering face-piece respirator of claim 5, wherein the one or more cross members extend in the longitudinal direction.

7. The filtering face-piece respirator of claim 5, wherein one or more cross members extend in the transverse direction.

8. The filtering face-piece respirator of claim 1, wherein the valve seat is integral to the support structure at a valve base.

9. The filtering face-piece respirator of claim 8, wherein the exhalation valve further includes a valve cover that is integral to the valve seat.

10. The filtering face-piece respirator of claim 8, wherein the valve base is about 2 to 5 mm thick and occupies an area of about 3 to 7 $cm^2$.

11. The filtering face-piece respirator of claim 10, wherein the valve base extends continuously 360° about an opening in the mask body when the valve seat is viewed from the front.

12. The filtering face-piece respirator of claim 11, wherein the cross members have a thickness of about 1 to 3 mm.

13. The filtering face-piece respirator of claim 12, wherein the valve seat and the support structure comprise a plastic that has a stiffness in flexure of about 75 to 300 MPa.

14. The filtering face-piece respirator of claim 1, wherein the valve seat and the support structure comprise a plastic that has a stiffness in flexure of about 100 to 250 MPa.

15. The filtering face-piece respirator of claim 1, wherein the valve seat and the support structure comprise a plastic that has a stiffness in flexure of about 175 to 225 MPa.

16. The filtering face-piece respirator of claim 2, wherein the filtering structure comprises a filtration layer and one or more cover webs.

17. A filtering face-piece respirator hat comprises:
a harness;
a mask body that comprises;
a filtering structure; and
a support structure that comprises a plurality of transversely-extending members that extend from a first side of the mask body to a second side, wherein at least one transversely-extending member of the plurality of transversely-extending members comprises a longitudinally-movable, transversely-extending member that extends from a first living hinge disposed on the first side of the mask body to a second living hinge disposed on the second side of the mask body; and
an exhalation valve that comprises a valve seat that includes a seal surface and a flexible flap, the exhalation valve being integral to the support structure at a base of the valve seat.

18. A method of making a filtering face-piece respirator, which method comprises:
providing a mask body that comprises a support structure that has an exhalation valve that is integral to the support structure, wherein the support structure further comprises a longitudinally-movable, transversely-extending member that extends from a first living hinge disposed on a first side of the mask body to a second living hinge disposed on a second side of the mask body; and
supporting at least one filtration layer on the support structure.

19. The method of claim 18, wherein the support structure further comprises a plurality of cross members, the exhalation valve being integral to the plurality of cross members.

20. The method of claim 18, wherein the filtration layer has an opening located therein, the exhalation valve being integral to the support structure at the opening, directly in front of where the wearer's mouth would reside when the respirator is being donned.

21. The method of claim 20, wherein the support structure further comprises a plurality of cross members, the exhalation valve being integral to the plurality of cross members.

22. The method of claim 21, wherein the exhalation valve has a base that encompasses an area of less than 16 $cm^2$, and wherein the base comprises members that are about 1 to 7 mm thick.

23. The method of claim 20, wherein the cross members include transversely-extending cross members that extend from the first side of the mask body to a second side.

* * * * *